US006145451A

United States Patent [19]

Zurl et al.

[11] Patent Number: 6,145,451

[45] Date of Patent: Nov. 14, 2000

[54] WATER-COOLED FIRING GRATE

[76] Inventors: Emil Zurl, Otto-Brenner Strasse 23, D-46483 Wesel; Jaroslav Aubrecht, Freiheitsstrasse 24, D-51373 Leverkusen; Anton Esser, Lichtenvoorder Strasse 42, D-41564 Kaarst, all of Germany

[21] Appl. No.: 09/308,193

[22] PCT Filed: Oct. 24, 1997

[86] PCT No.: PCT/EP97/05893

§ 371 Date: May 12, 1999

§ 102(e) Date: May 12, 1999

[87] PCT Pub. No.: WO98/25079

PCT Pub. Date: Jun. 11, 1998

[30] Foreign Application Priority Data

Dec. 6, 1996 [DE] Germany ..... 196 50 742

[51] Int. Cl.[7] ..... F23H 3/02; F23H 17/00; F23H 7/00; F23K 3/08

[52] U.S. Cl. ..... 110/298; 110/268; 110/328; 110/276; 126/181; 126/152 R

[58] Field of Search ..... 110/267, 268, 110/270, 297, 298, 300, 328, 275, 276; 126/181, 152 R, 163 R, 181 V, 152 B

[56] References Cited

U.S. PATENT DOCUMENTS

| | | | |
|---|---|---|---|
| 1,766,186 | 6/1930 | Ocenasek | 110/270 |
| 2,262,533 | 11/1941 | Hedge . | |
| 2,335,549 | 11/1943 | Stark | 110/47 |
| 3,563,190 | 2/1971 | Sprague | 110/39 |
| 4,385,567 | 5/1983 | Voss | 110/186 |
| 5,636,581 | 6/1997 | Kleen et al. | 110/270 |
| 5,724,898 | 3/1998 | Von Brockh et al. | 110/291 |
| 5,899,150 | 5/1999 | Martin et al. | 110/268 |
| 5,913,274 | 6/1999 | Kunzli et al. | 110/238 |
| 6,024,031 | 2/2000 | Stiefel | 110/281 |

FOREIGN PATENT DOCUMENTS

| | | | |
|---|---|---|---|
| 0 595 067 | 9/1993 | European Pat. Off. . | |
| 0 663 565 A2 | 7/1995 | European Pat. Off. . | |
| 0 621 449 B1 | 9/1995 | European Pat. Off. . | |
| 0 743 488 A2 | 4/1996 | European Pat. Off. . | |
| 8108923 | 11/1982 | France | 126/163 R |
| 2 530 319 | 3/1983 | France . | |
| 312 287 | 4/1917 | Germany . | |
| 340 602 | 1/1919 | Germany . | |
| 1 053 131 | 3/1959 | Germany . | |
| WO 95/18333 | 7/1995 | WIPO . | |
| 96/29544 | 9/1996 | WIPO . | |

*Primary Examiner*—Denise L. Ferensic
*Assistant Examiner*—Ken Rinehart

[57] ABSTRACT

A water-cooled firing grate made up of grate bar blocks extending over the width of the grate and each having a plurality of grate bars mounted on a grate bar carrier and interconnected by connecting pieces communicating between meandering shaped channels in the grate bar and a pair of end pieces forming an inlet and an outlet at the outer boundaries of the block and connected to an inlet and an outlet for the cooling water. The pieces are so fixed to the bars that they maintain a clearance between the bars of 1 to 1.5 mm.

10 Claims, 3 Drawing Sheets

WATER-COOLED FIRING GRATE

CROSS REFERENCE TO RELATED APPLICATIONS

This application is a national stage of PCT/EP97/05893 filed Oct. 24, 1997 and based, in turn, upon German national application 196 50 742,1 of Dec. 6, 1996 under the International Convention.

FIELD OF THE INVENTION

This invention relates to a water-cooled firing grate.

BACKGROUND OF THE INVENTION

Solid lump fuels such as coal, peat, chips of wood and waste can be burnt in a grate firing, in order to generate steam and possibly eliminate wastes. The grate is disposed in the combustion space either horizontally or at an angle. The grate consists of grate bars or grate plates, in or between which grate slots are provided. Stationary and movable grates are known. In the movable grates, the grate bars or plates are disposed on rotating rollers, or form an endless, moving belt, or are moved by vibration. The fuel is charged onto the grate in the form of a layer. In the case of moving grates, the fuel is transported through the combustion space under the influence of gravity and/or the vibration of the grate bars or the rotation of the grate rollers or the speed of movement of the grate belt, where it burns with the combustion air. The combustion air is supplied to the fuel layer from the bottom through the grate slots (primary air). It is possible to supply part of the combustion air-to the fuel layer also from the top (secondary air). The temperature at the surface of the grate bars and plates during the combustion and in particular during the ignition may reach values between 650 and 950° C., so that a cooling of the grate is required. Such cooling normally is effected by the combustion air. However, there are also known firing grates which are cooled with water. A small part of the ash formed during the combustion drops through the grate slots or through the spaces between the individual grate bar groups and is collected in ash hoppers. In the inclined and/or movable grates, the major part of the ash is dumped at the end of the grate. In the stationary, horizontal grates, the discharge of the ash is effected periodically, e.g. by shaking the grate bars or plates.

From DE-PS 312 287 there is known a water-cooled hollow grate with replaceable bars, where the hollow grate bars have recesses at their ends, in which the connecting pieces provided with flow passages as well as the connecting pieces provided with pipe connections are fixed by pressing devices. The connecting pieces generally connect two grate bars such that the entire grate forms a continuous pipe coil so to speak. The flow of coolant may be designed as desired depending on the arrangement of the connecting pieces provided with pipe connections, and each individual grate bar can be replaced after loosening only two connecting pieces. This construction has the disadvantage that the connecting pieces and abutments are in part disposed in direct vicinity of the combustion space and are therefore subject to a constant wear. In addition, the great distance of the grate bars produces a small grate resistance on the downstream side, which has a negative influence on the course of the combustion.

From DE-PS 340 602 there is known a hollow grate with circulation of water, which has additional air passages that distribute the combustion air over the grate surface. The additional air passages are formed by-the jacket of a water chamber protruding above the grate over its entire length, and below the wided top of the water chamber open into the combustion space. The coolant water flows through the hollow grate bars of the known grate. The grate slots form incisions in the grate bar, around which flows the water contained in the hollow bars. By means of a corresponding line, the circulating water is connected with a feed water tank. By heating the water circulating in the hollow grate, the grate is protected and at the same time the water cooling of the grate is utilized for heating the feed water. This known combustion grate has the disadvantage that it is stationary and can only be operated with low-ash fuels.

DE-AS 1 053 131 discloses a firing grate with divided grate bars, which rest on pipes through which flows water. The grate bars are inserted from the top between the pipes, and are pressed against the pipes with a recess corresponding to the pipe section. This firing grate has the disadvantage that it has a complex technical construction; in technical terms it may be constructed simpler by using jacket pipe walls.

From WO 95/18333 there is finally known a sliding firing grate module for the combustion of waste in commercial plants, which has a plurality of grate steps movable with respect to each other as well as a primary air supply, where its supporting elements as well as its grate consist of hollow parts made of sheet metal, through which flows a liquid cooling medium in the built-in condition. The individual grate steps each consist of a hollow grate plate, the length of which is designed to extend over the entire width of the firing grate to be produced. The grate plate is hollow inside and has at least one connecting port and one discharge port for the supply and discharge of the coolant. Below the grate a pipe extends over the entire length of the grate, which serves as cooling water flow pipe, and from which tube connections lead to each grate plate or grate step or the cooling chambers thereof. Tube connections are provided, which as separate cooling-water recirculations lead back from each grate plate or grate step or the cooling chambers thereof to the control elements for the control of the coolant. The primary air is supplied through holes which extend through the grate plates. This construction has the disadvantage that the combustion air is supplied through the grate bar only partially and does not uniformly aerate the fuel, so that a high thermal load of the grate is impeded.

OBJECT OF THE INVENTION

It is the object of the invention to provide a firing grate cooled with water, which admits a high thermal load of 0.9 to 1.1 $MW/m^2$ grate area, which has a low wear, and which requires a small maintenance effort.

SUMMARY OF THE INVENTION

The object underlying the invention is achieved by a water-cooled firing grate, which consists of a plurality of blocks of grate bars extending over the width of the grate, each block consisting of multiple grate bars, wherein each grate bar has a meander-shaped channel in addition to several cut-in grate slots inside. The grate bars are furthermore connected with each other by screwable connecting pieces such that a grate slot is formed between two grate bars. In the interior of the connecting pieces a connecting passage extends, which connects the meander-shaped channels of two grate bars. The grate bars positioned on the boundaries of the grate have screwable inlet and outlet pieces, through which the liquid coolant water is supplied and discharged.

Because of the cooling of the grate with the liquid coolant water, the temperature at the surface of the grate bar is 90 to 110° C. The result is a reduction of the wear of the grate and the grate has a high thermal load-bearing capacity of 0.9 to 1.1 $MW/m^2$ grate area. This leads to the fact that the inventive grate can be built smaller by about 30% as compared to the known air-cooled grates with the same thermal efficiency. The meander-shaped design of the channels arranged in the interior of the grate bars, through which flows the coolant, and the connecting, inlet and outlet pieces to be used in accordance with the invention advantageously cooperate such that the supply and discharge of the coolant is only effected from the boundaries of the grate. The individual blocks of grate bars or several blocks of grate bars can thus be provided with the coolant at the boundaries of the grate, so that the operational safety is increased. The connecting pieces ensure that between the individual grate bars, of which a block of grate bars consists, grate slots are formed, which do not change their width during the operation. This high dimensional accuracy of the inventive firing grate ensures both a minor passage of ash through the grate and an optimum supply with combustion air and a substantial burn-out of the fuel on the grate, so that finally a high thermal load is achieved.

In accordance with the invention it is furthermore provided the connecting, inlet and outlet pieces enclose a grate bar carrier and are screwed to the carrier. The meander-shaped channels of the grate bars are connected with each other via the connecting passages of the connecting pieces. The dimensional accuracy of the blocks of grate bars and the operational safety of the firing grate are thus increased.

In accordance with the invention it is particularly advantageous that the individual grate bar blocks can be moved by means of the grate bar carriers, and/or that the firing grate has an angle of inclination of 8 to 11°. The movability of the grate bar blocks does not reduce the operational safety of the firing grate designed in accordance with the invention. The inventive firing grate may be designed for instance as an inclined counterflow grate or as an inclined feed grate or as a horizontally arranged feed grate.

In a further aspect of the invention the grate slots have a width of 1 to 1.5 mm. This width of the grate slots ensures that the fuel disposed on the grate does not drop through the slots, and that enough combustion air gets into the fuel layer. In particular the grate slots provided between two grate bars do not change their width during the operation, as the connecting pieces fix the individual grate bars such that a grate slot-width of 1 to 1.5 mm is reliably maintained.

In accordance with the invention it is furthermore provided that the connections between the grate bars and the connecting pieces or the inlet and outlet pieces are sealed by a flush cut of the contact surfaces of the workpieces and by graphite seals. Due to the cooperation of the flush cut contact surfaces of the workpieces with the graphite seals and with the inventive screw connections of the individual workpieces an absolutely reliable sealing of the cooling system is achieved, so that the operational safety of the firing grate is also ensured over an extended operation.

In accordance with the invention the grate bars lie on the connecting, inlet and outlet pieces and screwed to the connecting, inlet and outlet pieces by means of vertically extending screws. The large contact area and the screw connection lead to a good fixation of all workpieces and a safe sealing of the cooling system.

In some cases it turned out to be expedient when a horizontal, air-cooled firing grate known per se is provided downstream of the inventive firing grate. In this way, a high burn-out of the fuel is advantageously achieved, although the thermal load-bearing capacity of the air-cooled firing grate is only 0.5 to 0.8 $MW/m^2$ grate area. Alternatively, a second inventive, horizontal, water-cooled firing grate can be provided downstream of the inventive firing grate, so that a high fuel burn-out is achieved with a high load-bearing capacity of the grate.

The postcombustion can be improved in accordance with the invention in that at the upstream side of the second air-cooled or water-cooled firing grate nozzles are provided, through which pulsed combustion air is introduced into the combustion space, where the pulsed air may also be preheated.

In accordance with the invention the horizontal, air-cooled firing grate provided subsequent of the inventive firing grate has connecting and end pieces, which have no connecting passages, but are otherwise designed corresponding to the connecting, inlet and outlet pieces.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
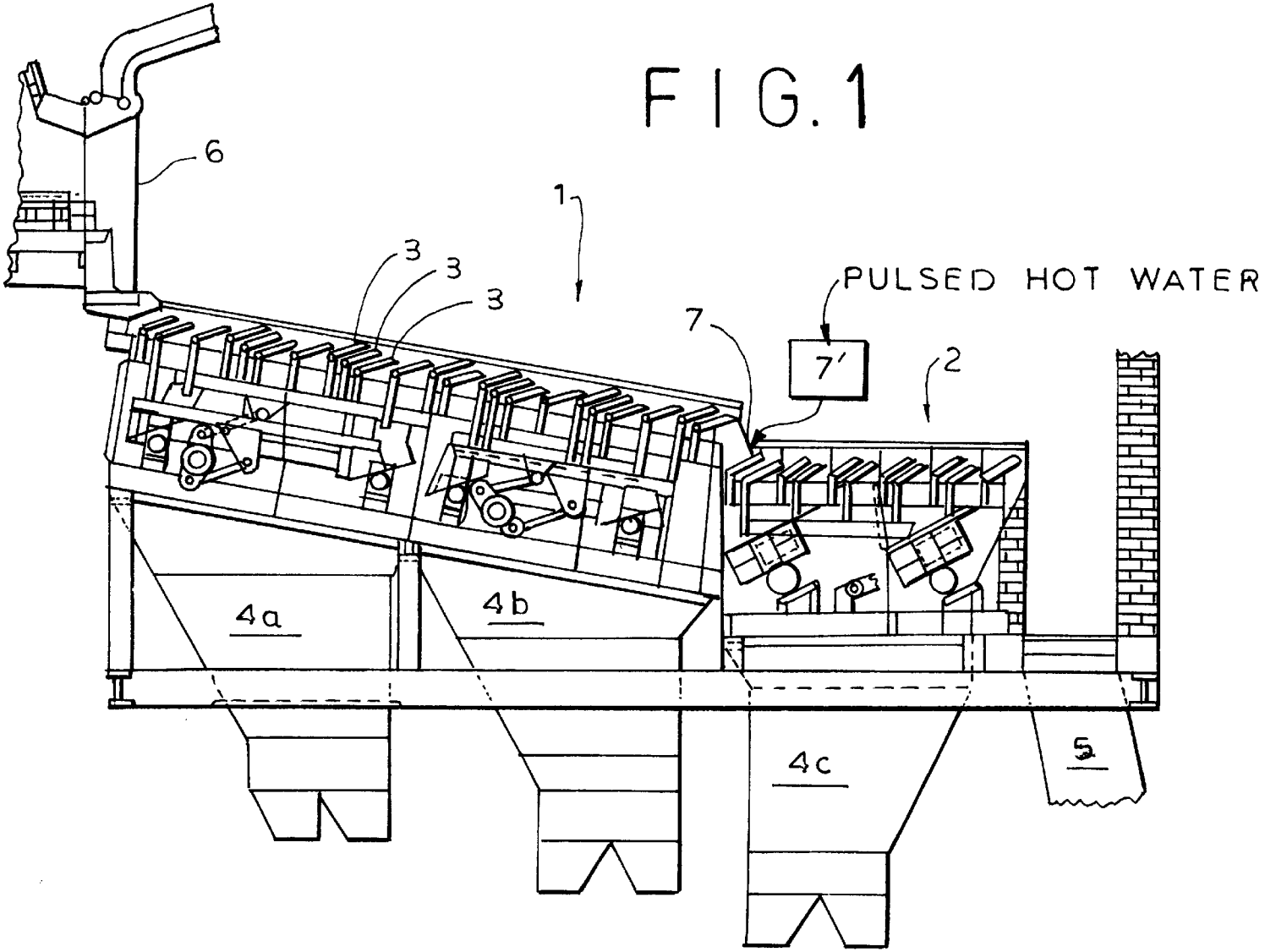
FIG. 1 shows in diagrammatic section an inventive firing grate, followed by a horizontal, air-cooled firing grate is provided.

The arrangement represented in FIG. 1 consists of an inventive firing grate 1 and downstream thereof, an air-cooled known firing grate 2. The firing grate 1 has an angle of inclination of 10° and in its front part is designed as counterflow grate and in its rear part is designed a feed grate, where these two constructions belong to the known prior art and employ movable grate bar blocks 3. Both parts of the firing grate 1 have a length of about 3.5 m and a width of 3 m. However, these dimensions may also be smaller or larger. The width may be varied corresponding to the mass flow rate of the fuel. The air-cooled firing grate 2 is disposed horizontally and has a length of about 3.4 m as well as a width of 3 m. The width of the air-cooled grate may also be varied corresponding to the mass flow rate of the fuel. The firing grate 1 is operated with an average thermal load of 0.94 $MW/m^2$, whereas the air-cooled firing grate 2 operates with a thermal load of 0.64 $MW/m^2$. The ash particles falling through the firing grates 1 and 2 are collected in the ash hoppers 4*a*, 4*b* and 4*c*, and this ash is delivered to the ash discharge 5, into which there is also dumped the ash from the end of the firing grate 2. As fuel, waste is supplied to the arrangement represented in FIG. 1 via the feeder 6. The combustion air is introduced into the fuel layer from the bottom via the ash hoppers 4*a*, 4*b*, 4*c* through the grates 1, 2. The firing grate 1 is operated with an average excess-air coefficient of about 1.1. In the front part of the firing grate 2 or at the transition between the firing grates 1 and 2, i.e. at the grate step 7, there are provided nozzles represented in the drawing by 7, through which the pulsed, hot combustion air can be introduced into the combustion space. In the combustion space, i.e. above the fuel layer, the temperature is 1100 to 950° C. In the fuel layer, the temperature is 700 to 800° C. At the surface of the grate bar blocks 3 of the firing grate the temperature is 90 to 110° C. due to the water cooling. At the surface of the grate bar blocks of the firing grate 2 the temperature is 400 to 600° C. It is quite obvious that the inventive firing grate cannot be designed as roller grate or as travelling grate, as in these constructions the cooling provided in accordance with the invention cannot be realized with a reasonable economic effort. It is possible to introduce combustion air into the combustion space above the firing grate 1. By introducing the combustion air into the combustion space, i.e. above the fuel layer, there is in particular achieved an optimum combustion of the gaseous constituents escaping from the fuel. The combustion air, which is introduced into the combustion space via the nozzles provided at the grate step 7, also promotes the combustion of the gaseous fuel constituents as well as the postcombustion of the fuel.

Figure 2:
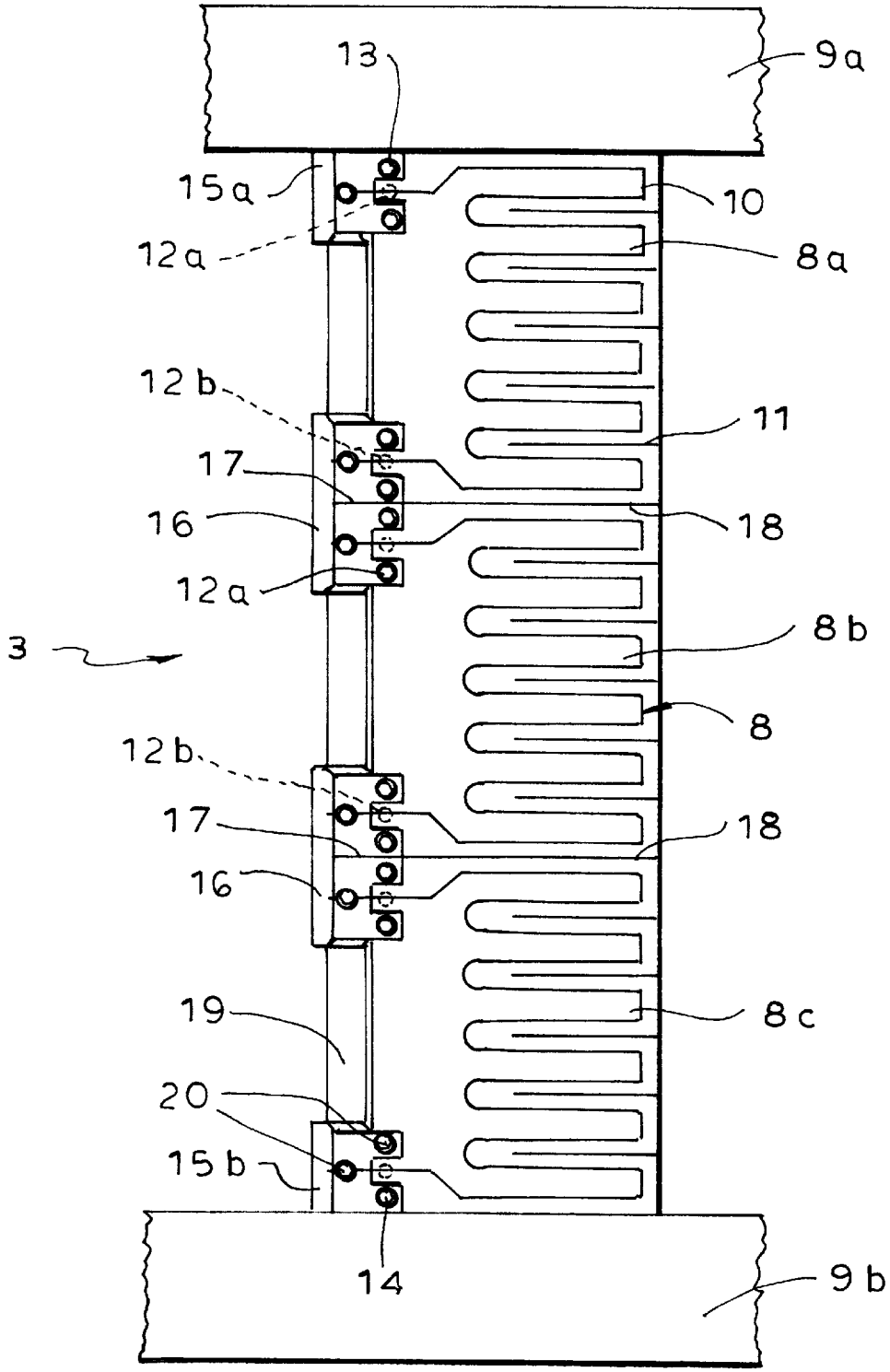
FIG. 2 is a detail which illustrates the design of a block of grate bars.

The grate bar block 3 schematically represented in FIG. 2 consists of several grate bars 8*a*, 8*b*, and 8*c*. The grate bars 8 have a length of 400 to 600 mm and a width of 400 to 700 mm. The grate bar blocks 3 are disposed inside the grate limits 9*a*, 9*b*. In the interior of each grate bar 8, a meandershaped channel 10 is provided, which for instance has a diameter of 20 mm, and in which flows the coolant water. The amount of cooling water is dimensioned such that after the passage through one or several grate bar blocks 3 it has a temperature of 60 to 95° C.; during the cooling process, no steam is formed. Into the grate bars 8, several grate slots 11 of equal length, width and shape have been milled, where the width of the grate slots 11 is 1 to 1.5 mm. Through the grate slots 11, combustion air is supplied to the fuel layer from the bottom. Each grate bar 8 has an inlet opening 12*a* and an outlet opening 12*b* for the cooling water. The cooling water is supplied to the grate bar block 3 from the outside via line 13 and is discharged to the outside via line 14.

Onto the grate bars 8*a* and 8*c*, which are positioned at the grate boundary 9*a*, 9*b*, inlet and outlet pieces 15*a* and 15*b* are placed, which are screwed to the grate bars 8*a* and 8*c*. The lines 13 and 14 open into the inlet and outlet pieces 15*a*, 15*b*. The grate bars 8*a* and 8*c* are connected with the grate bar 8*b* by means of connecting pieces 16 placed onto the same and are firmly positioned. The connecting pieces 16 are screwed to the grate bars 8. All screws used 20 are guided at an angle of 90°, i.e. perpendiculary with respect to the supporting surfaces. In the interior of the connecting pieces 16 a connecting passage 17 extends, through which the cooling water flows from one grate bar into the other. The surfaces of the inlet and outlet pieces 15*a*, 15*b* and of the connecting pieces 16, which lie on the grate bars 8, as well as the corresponding opposite surfaces of the grate bars 8 are provided with a planar cut, so that in cooperation with the screw connection a high degree of tightness of the cooling system can already be achieved. In addition, the transition between the grate bars 8 and the connecting, inlet and outlet pieces is sealed by means of a graphite seal 21, so that finally a very reliable, durable and rugged seal of the cooling system is achieved. The individual grate bars 8 are positioned with respect to each other by means of the connecting pieces 16 such that between the same a grate slot 18 is formed, whose width likewise is 1 to 1.5 mm. The fixation of the grate bars 8 achieved by means of the connecting pieces 16 is so stable that the width of the grate slots 18 does not change during the operation. It was found out that merely the combination of the grate bars 8 by means of the connecting pieces 16 is not sufficient to ensure the dimensional accuracy of the grate bar blocks 3.

Figure 3:
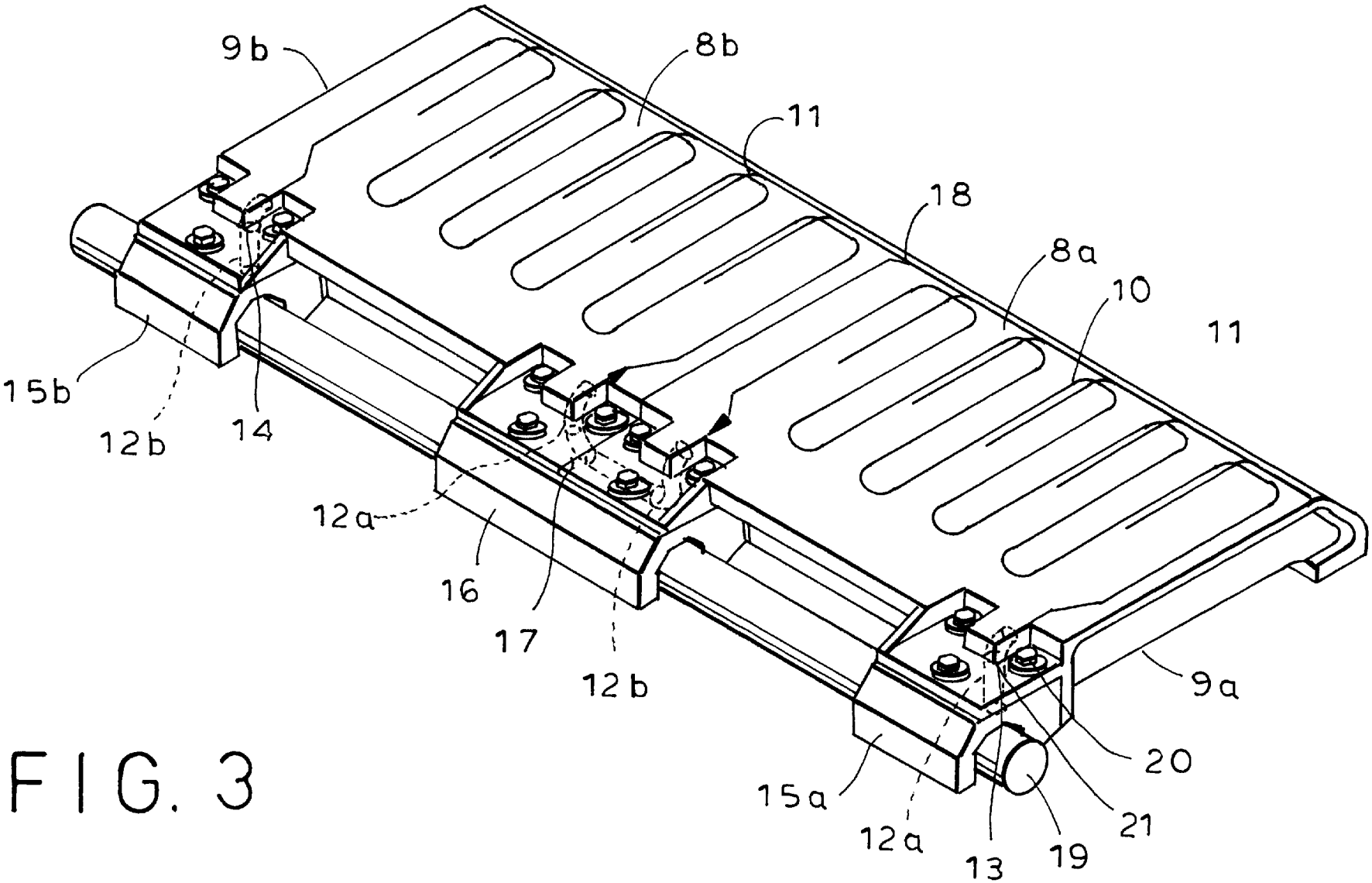
FIG. 3 is a perspective view which shows in detail the connection between the block of grate bars and the grate bar carrier.

It is advantageous when the inlet and outlet pieces 15*a*, 15*b* as well as the connecting pieces 16 are fitted into corresponding recesses, formed in the grate bars 8. A corresponding representation is shown in FIG. 3.

The connection of the grate bar block 3 consisting-of several grate bars 8*a*, 8*b*, 8*c* with the drive members of the firing grate is produced by means of the grate bar carrier 19. The inlet and outlet pieces 15*a*, 15*b* as well as the connecting pieces 16 are firmly connected with the grate bar carrier 19. In accordance with FIG. 3, this can be achieved in that the inlet and outlet pieces 15*a*, 15*b* as well as the connecting pieces 16 are disposed flush around the grate bar carrier 19 and are screwed both to the grate bars 8 and to the grate bar carrier 19. The generally movable grate bar carrier 19 thus moves the grate bar block 3 both via the inlet and outlet pieces 15*a*, 15*b* acting as claws and via the connecting pieces 16 and drives said grate bar block.

What is claimed is:

1. A water-cooled firing grate comprising a plurality of grate bar blocks extending over a width of the grate, each of said grate bar blocks being composed of several grate bars each of said grate bars having a meander-shaped channel in an interior of the grate bar as well as several cut-in grate slots the grate bars being connected with each other by screwable connecting pieces such that between each two grate bars of a grate bar block a respective grate slot is formed, each of the connecting pieces having in an interior thereof a connecting passage which connects the meander-shaped channels of two grate bars, each grate bar block having grate bars positioned at boundaries of the grate and having screwable inlet and outlet pieces through which the liquid coolant water is supplied and discharged.

2. The firing grate as claimed in claim 1 wherein the connecting piece, the inlet piece and the outlet piece enclose a grate bar carrier and are screwed to the grate bar carrier.

3. The firing grate as claimed in claim 1 wherein the grate bar blocks can be moved by means of the grate bar carriers.

4. The firing grate as claimed in claim 1 which has an angle of inclination of 8 to 11°.

5. The firing grate as claimed in claim 1 wherein said grate slots have widths of 1 to 1.5 mm.

6. The firing grate as claimed in claim 1 wherein connections between the grate bars and the connecting pieces or the inlet and outlet pieces are sealed by a flush cut of respective contact surfaces of the connecting pieces, inlet pieces, and outlet pieces and by graphite seals.

7. The firing grate as claimed in claim 1 wherein the grate bars are placed onto the connecting, inlet and outlet pieces and screwed to the connecting, inlet and outlet pieces by means of perpendicularly extending screws.

8. The firing grate as claimed in claim 1 downstream of which a horizontal, air-cooled firing grate is provided.

9. The firing grate as claimed in claim 1 downstream of which a horizontal, water-cooled firing grate is provided.

10. The firing grate as claimed in claim 8 wherein at an upstream end of a subsequent firing grate, nozzles are disposed through which pulsed combustion air is introduced into a combustion space.

* * * * *